US006095407A

United States Patent [19]

Ward et al.

[11] Patent Number: 6,095,407

[45] Date of Patent: Aug. 1, 2000

[54] MAILER BLANK

[75] Inventors: John W. Ward, Fairhope, Ala.; Tyson A. Harris, Clarksville, Tenn.

[73] Assignee: Poser Business Forms, Inc., Fairhope, Ala.

[21] Appl. No.: 09/030,328

[22] Filed: Feb. 25, 1998

[51] Int. Cl.[7] ..... B65D 27/00

[52] U.S. Cl. ..... 229/92.1; 229/69

[58] Field of Search ..... 229/69, 92.1

[56] References Cited

U.S. PATENT DOCUMENTS

| | | | |
|---|---|---|---|
| 4,928,875 | 5/1990 | Hutchinson . | |
| 4,951,864 | 8/1990 | Dicker . | |
| 5,174,493 | 12/1992 | File | 229/92.1 X |
| 5,294,041 | 3/1994 | Whiteside | 229/69 |
| 5,376,048 | 12/1994 | Whiteside | 229/69 X |
| 5,622,390 | 4/1997 | Jenkins | 229/300 X |
| 5,785,242 | 7/1998 | Lombardo | 229/92.1 X |
| 5,829,670 | 11/1998 | Lombardo et al. | 229/69 X |

*Primary Examiner*—Jes F. Pascua
*Attorney, Agent, or Firm*—Howell & Haferkamp, LC

[57] ABSTRACT

A mailer blank adapted to be folded into a mailer has front and back sides and adhesive bands on the front side and on the back side for securing the blank in its folded configuration. At least one of the adhesive bands on the front side is aligned with at least one of the adhesive bands on the back side, the aligned adhesive bands on the front side and on the back side comprising a series of spaced shaped patches. The patches comprising the adhesive band on the front side are shaped and spaced with respect to the patches comprising the adhesive band on the back side that when the mailer blanks are stacked one on top of the other, the patches comprising the adhesive band on a side of the mailer blank do not align with the patches comprising the adhesive band on the opposite side of the adjacent blank.

8 Claims, 4 Drawing Sheets

MAILER BLANK

FIELD OF THE INVENTION

This invention relates to a blank for a mailer, and in particular to a blank with adhesive bands on the front and back faces configured to allow narrow margins and provide a large printable area.

BACKGROUND OF THE INVENTION

Mailer blanks are typically 8½ inch wide sheets so that they can pass through conventional printers. These sheets have fold lines and adhesive strips so that after passing through a printer the blank can be folded and secured for mailing. Current printers and printer software can print across the entire width of the blank, and to take advantage of this capability it is desirable to make the side edge margins (where the adhesive strips are primarily located) as narrow as possible to provide the largest possible printing area.

In typical C-fold and Z-fold mailer configurations the blanks have adhesive strips on the front and rear faces of the sheet. However, the adhesive strips on the opposing faces of adjacent blanks in a stack must not be aligned or the adhesive strips may adhere the blanks together. Thus, where, as frequently happens, the design of the blank requires that adhesive strips be located in aligned positions on the front and rear face of the blank, the adhesive strips must be laterally offset so that they are not aligned when the blanks are stacked. When this offset, the thickness of the strips, and manufacturing tolerances are taken into consideration, the margins must be fairly large and thus the printable area of the blank is reduced.

SUMMARY OF THE INVENTION

The mailer blank of the present invention is adapted to be printed upon and folded into a mailer. The blank generally comprises a sheet having front and rear faces. The sheet has fold lines and adhesive bands so that it can be folded and secured. Some of the adhesive bands on the front face and rear face cover corresponding areas. According to the principles of this invention, these adhesive bands are comprised of spaced shaped patches of adhesive, sized, shaped, and spaced so that the when the blanks are stacked the patches forming the adhesive bands on the opposing faces of adjacent blanks do not overlap. Thus adjacent blanks will not adhere to each other. However, because the adhesive bands can occupy the same portions on the front and rear faces of the blank, the width of the margins can be minimized providing a large printable area on the blank.

In the preferred embodiment the adhesive patches forming the adhesive bands on one face of the blank are triangle-shaped with their apices oriented in one direction and the adhesive patches forming the adhesive bands on the other face of the blank are triangle-shaped with their apices oriented opposite from the patches on the first side. As shown in the drawing the triangle-shaped adhesive patches are spaced from each other along the adhesive band less than the dimension of the base of the triangle-shaped adhesive patches.

The configuration of the adhesive bands on this invention allows adhesive bands to occupy the same position on opposite sides of the blank without the patches overlapping with the attendant risk that adjacent sheets will adhere together.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

A mailer blank constructed according to the principles of this invention is indicated generally as 20 in the Figures. As shown and described herein, the mailer 20 is a C-fold mailer, but the invention is not so limited and applies to mailers of other configurations, such as Z-fold mailers.

Figure 1:
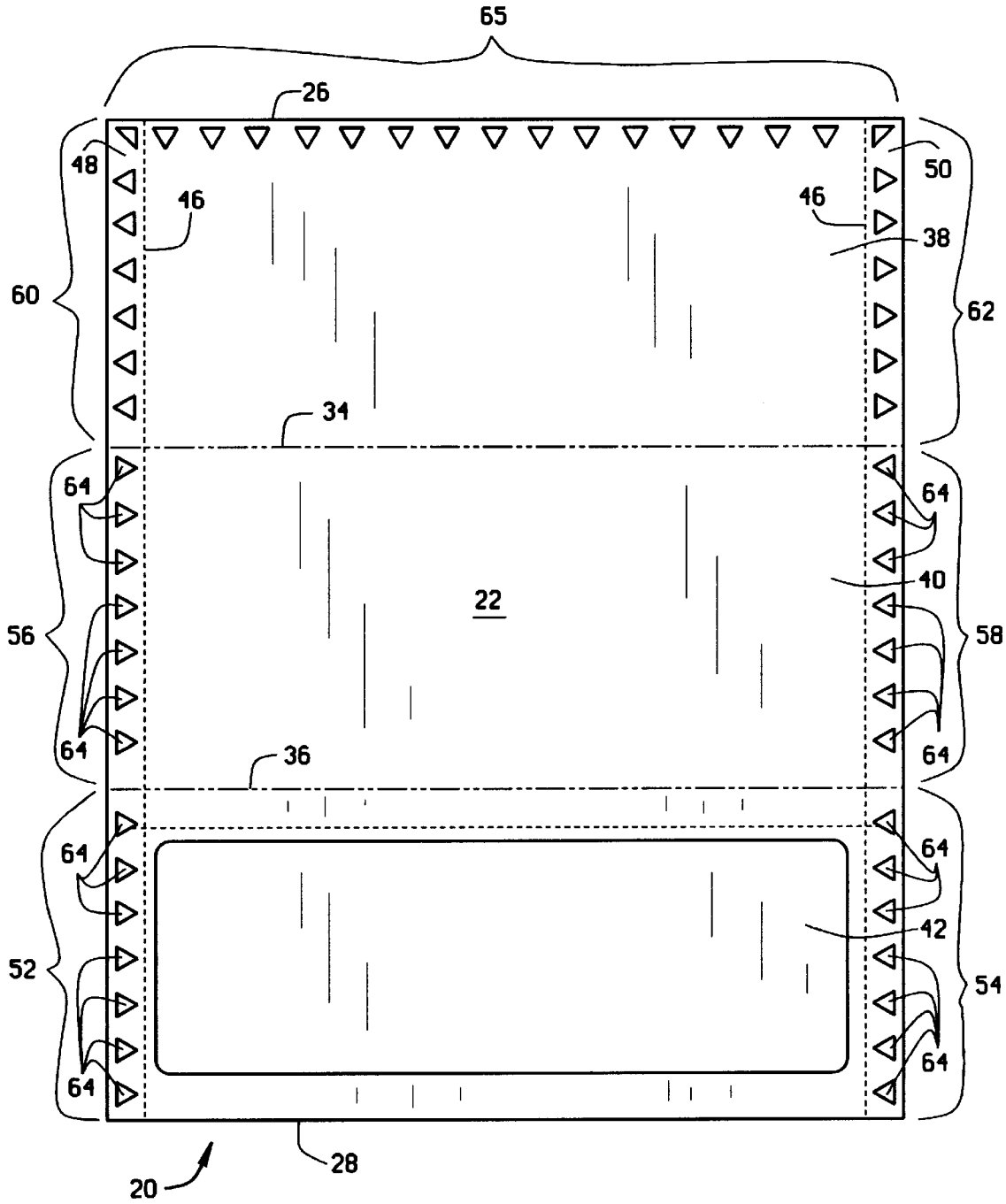
FIG. 1 is a front view of a first embodiment of a mailer blank for a C-fold mailer constructed according to the principles of this invention.
Figure 2:
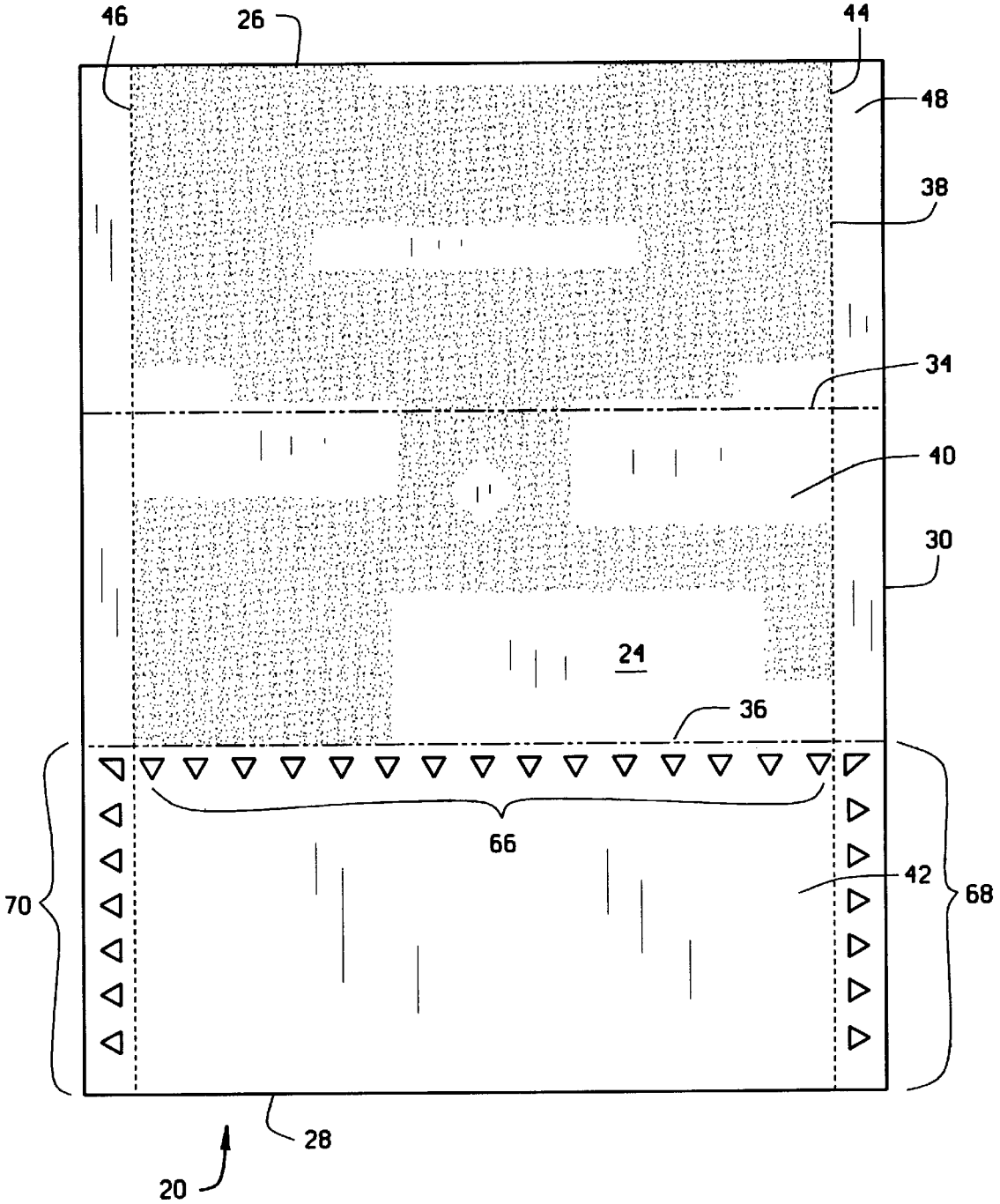
FIG. 2 is a rear view of the mailer blank.

The mailer 20 is a sheet having a front face 22 (FIG. 1) and a rear face 24 (FIG. 2). The mailer has parallel top and bottom edges 26 and 28, and parallel left and right (as viewed from the front) edges 30 and 32. First and second fold lines 34 and 36, which may be perforated, extend between the left and right side edges 30 and 32, to divide the sheet into top, middle and bottom panels 38, 40, and 42. Lines of perforations 44 and 46 extend adjacent the left and right sides edges 30 and 32, forming left and right margins 48 and 50.

There are first and second adhesive bands 52 and 54 adjacent the left and right sides 30 and 32, respectively, of the front face 22, on the lower panel 42, between the second fold line 36 and the bottom edge 28. There are third and fourth adhesive bands 56 and 58 adjacent the left and right sides 30 and 32, respectively, of the front face 22, on the middle panel 40 between the first and second fold lines 34 and 36. There are fifth and sixth adhesive bands 60 and 62 adjacent the left and right sides 30 and 32, respectively, of the front face 22, on the top panel 38 between the top edge 26 and the first fold line 34. There is a seventh adhesive band 65 adjacent the top edge 26 on the top panel 38, between the left and right sides 30 and 32.

There is an eighth adhesive band 66 adjacent the second fold line 36 on the bottom panel 42 between the right and left sides 32 and 30 on the rear face 24. There are ninth and tenth adhesive bands 68 and 70 adjacent the right and left sides 32 and 30.

Figure 3:
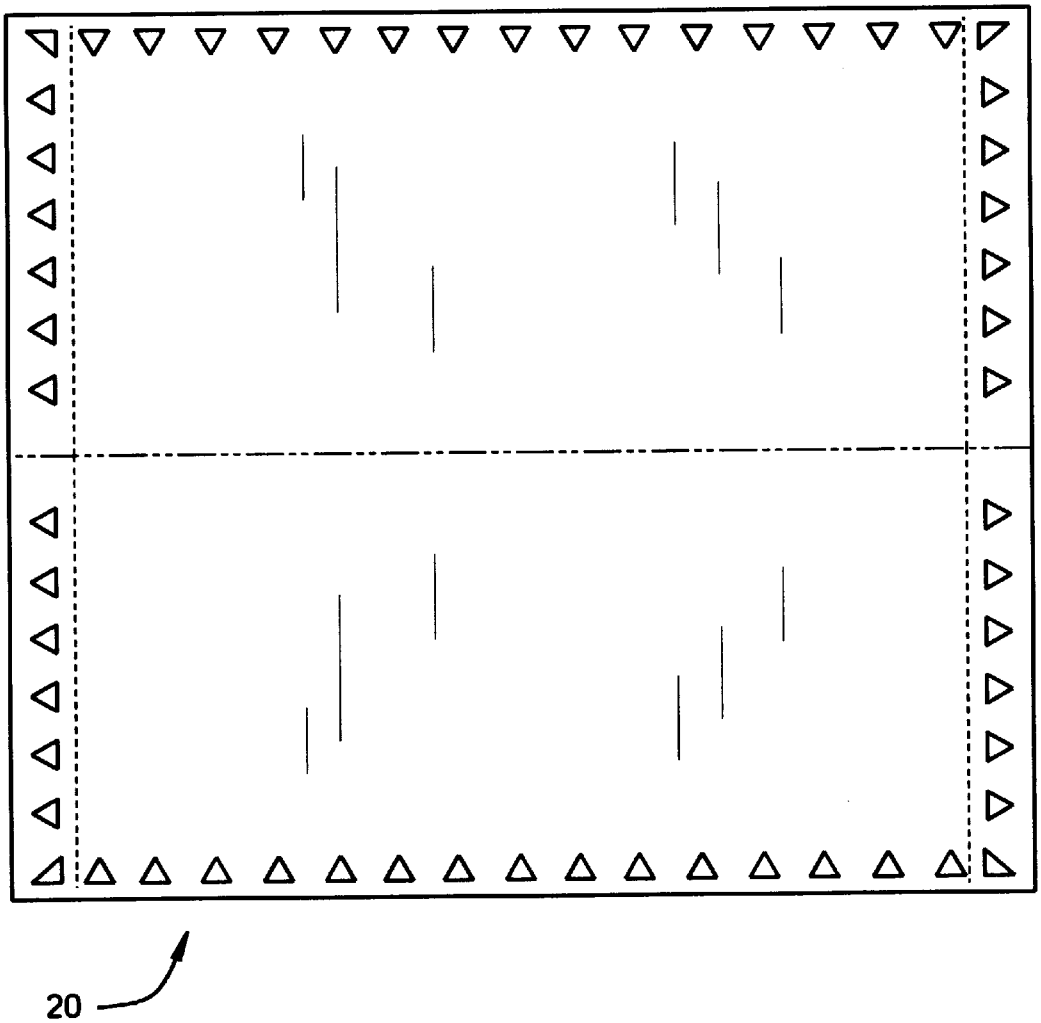
FIG. 3 is a front view of the mailer blank with the bottom panel folded over the middle panel.

The bottom panel 42 is adapted to be folded over the middle panel 40 along second fold 36. (See FIG. 3). The first adhesive band 52 overlaps the third adhesive band 56, and the second adhesive band 54 overlaps the fourth adhesive band 58. The adhesive bands 52 and 56 and 54 and 58 each comprise corresponding patterns of spaced, patches 64 of a pressure-activated adhesive. In this preferred embodiment the patches 64 are spaced triangles, oriented with their bases parallel to the sides of the sheet, their apices pointing to the center of the sheet and spaced from each other less than the dimension of their base. Each patch 64 in the first adhesive band 52 aligns with a patch 64 in the third adhesive band 56, and each patch 64 in the second adhesive band 54 aligns with a patch 64 in the fourth adhesive band 58.

The top panel 38 is adapted to be folded over the middle and bottom panels 40 and 42 along first fold line 34. The seventh adhesive band 65 overlaps the eighth adhesive band 66, the fifth adhesive band 60 overlaps the ninth adhesive band 68, and the sixth adhesive band 62 overlaps the tenth adhesive band 70.

The adhesive bands 65 and 66, 60 and 68, and 62 and 70 each comprise corresponding patterns of spaced patches 64. In this preferred embodiment the patches 64 are triangles spaced from each other less than the dimension of their base. In bands 60 and 68 the bases of the triangles are parallel to the left edge 30, with the apices pointing outwardly; in bands 62 and 70 the bases of the triangles are parallel to the right side edge 32, with the apices pointing outwardly; in band 65 the bases of the triangles are parallel to the top edge 28, with the apices pointing inwardly; and in band 66 the bases of the triangles are parallel to the second fold line 36 and the apices point toward the bottom edge 28.

The first and second adhesive bands 52 and 54 on the first face 22 are aligned with the ninth and tenth bands 68 and 70 on the second face 24. However the triangular patches 64 comprising the first and second adhesive bands 52 and 54 face oppositely from the patches 64 comprising the ninth and tenth adhesive bands 68 and 70 and the patches on the front face 22 are offset from the patches on the rear face 24 so that when the blanks 20 stacked, the patches on one face of a blank are not aligned with the patches on the opposing faces of the adjacent blanks in the stack.

OPERATION

In operation the blanks 20 are stacked. Because of the size, shape, and spacing of the patches comprising the adhesive bands on the front and back faces, the patches 64 on the opposing faces of adjacent sheets do not align and therefore do not stick together. The mailer blank 20 is printed and then folded. The bottom panel 42 is folded over the middle panel 40 along the fold line 36. The patches 64 in the first and second adhesive bands 52 and 54 align with the patches 64 in the third and fourth bands 56 and 58.

The top panel 38 is then folded over the lower panel 42 along the fold line 34. The patches 64 in the adhesive bands 64, 60, and 62 align with the patches 65 in the adhesive bands 66, 68 and 72. The C-folded mailer is then ready for mailing.

Figure 4:
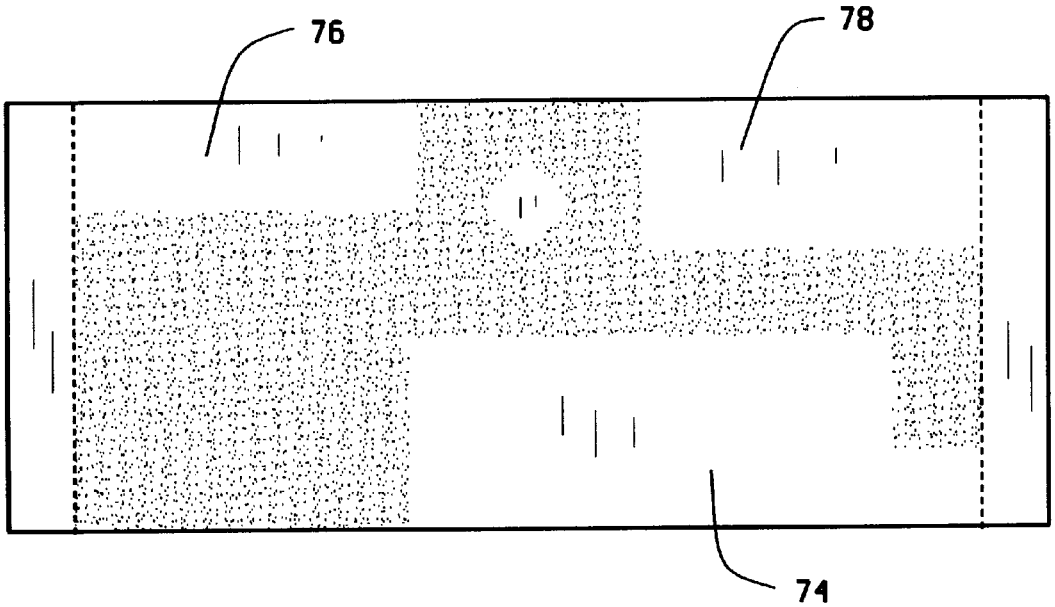
FIG. 4 is a front view of the mailer blank with the top panel folded over the bottom panel in its final C-folded configuration.
Figure 5:
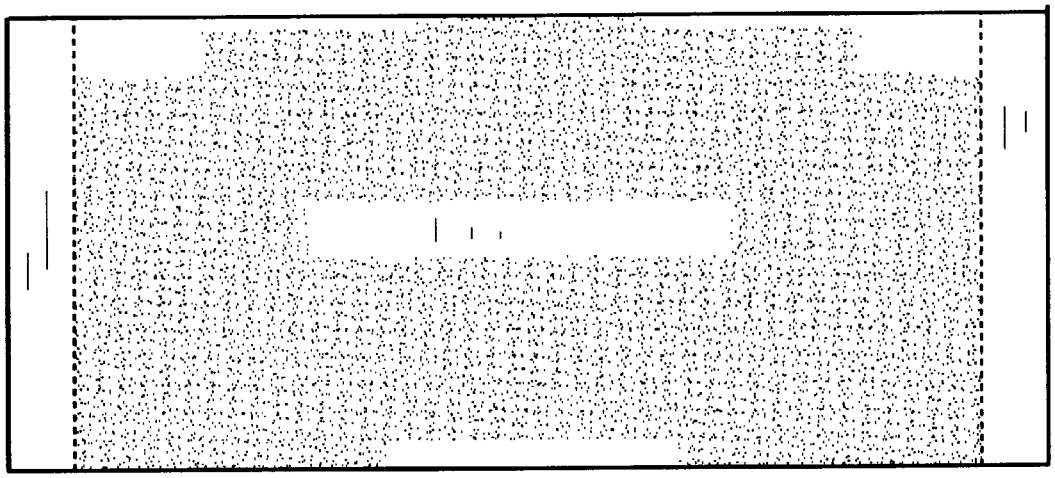
FIG. 5 is a rear view of the mailer in its final C-folded configuration.

An address can be printed in address box 74, a return address printed or preprinted in return address box 76, and postage applied or preprinted in postage box 78. These boxes are on the middle panel 40 on the back 24 of the blank, which as shown in FIG. 4 forms the front of the mailer.

What is claimed is:

1. A mailer blank adapted to be folded into a mailer, the blank comprising a sheet having front and back sides and adhesive bands on the front side and on the back side for securing the blank in its folded configuration, at least one of the adhesive bands on the front side being aligned with at least one of the adhesive bands on the back side, the aligned adhesive bands on the front side and on the back side comprising a series of spaced generally triangular shaped patches, the patches comprising the adhesive band on the front side being spaced with respect to the patches comprising the adhesive band on the back side that when the mailer blanks are stacked one on top of the other, the patches comprising the adhesive band on one side of a mailer blank do not align with the patches comprising the adhesive band on the opposite side of the adjacent blank, the patches forming one of two aligned adhesive bands being oriented oppositely from the patches forming the other of the two aligned adhesive bands.

2. The mailer blank according to claim 1 wherein the series of spaced generally triangular shaped patches are spaced from each other less than the dimension of the base of the generally triangular shaped patches.

3. A mailer blank comprising a sheet having front and rear surfaces and having top, bottom and side edges, the top and bottom edges parallel to one another and the side edges parallel to one another, first and second fold lines located between and parallel to the top and bottom edges dividing the sheet into at least three panels, and a plurality of glue bands on the front and rear surfaces for securing the panels together when the sheet is folded along the fold lines, at least some of the glue bands on the front face being aligned with some of the glue bands on the rear face, each of these glue bands comprising a plurality of patches of adhesive, generally triangular shaped and spaced so that the patches forming the glue bands on the front surface are offset from the patches forming the glue bands on the rear surface, so that when a plurality of the sheets are stacked, the patches forming the glue bands on one surface of the sheet do not overlap the patches forming the glue bands on the opposite face of the adjacent sheet, the patches forming one of two aligned adhesive bands being oriented oppositely from the patches forming the other of the two aligned adhesive bands.

4. The mailer blank according to claim 3 wherein the generally triangular shaped patches forming the aligned glue bands are spaced from each other less than the dimension of the base of the generally triangular shaped patches.

5. A mailer blank adapted to be folded into a mailer, the blank comprising a sheet having front and rear surfaces, and top, bottom, and side edges, the top and bottom edges parallel to one another, first and second fold lines located between, and parallel to, the top and bottom edges, dividing the sheet into top, middle, and bottom panels; first and second adhesive bands adjacent the left and right sides, respectively of the front face of the lower panel, between the second fold line and the bottom of the panel; third and fourth adhesive bands adjacent the left and right sides, respectively, of the front face of the middle panel, between the first and second fold lines; fifth and sixth adhesive bands adjacent the left and right sides of the front surface of the top panel, between the top edge and the first fold line; a seventh adhesive band adjacent the top edge of the front face of top panel; an eighth adhesive band on the rear surface of the bottom panel, adjacent the second fold line; ninth and tenth adhesive bands adjacent the right and left sides of the rear surface of the bottom panel; each of the adhesive bands being formed by a plurality of spaced adhesive patches, the patches in the first and second bands aligning with the patches in the third and fourth bands, to allow the middle and bottom panels to be secured together and the patches in the fifth and sixth bands aligning with patches in the ninth and tenth bands and the patches in the eighth band aligning with the patches in the seventh band to hold the top panel and the bottom panel together, the first and second bands on the front surface of one blank being generally aligned with the ninth and tenth bands on the back surface of an adjacent blank the patches forming the first and second and ninth and tenth adhesive bands being generally triangular shaped and spaced so that the patches do not align, and the patches forming the first and second bands face oppositely from the patches forming the ninth and tenth bands.

6. The mailer blank according to claim 5 wherein the generally triangular shaped patches forming the first and second and ninth and tenth adhesive bands are spaced from each other less than the dimension of the base of the generally triangular shaped patches.

7. A mailer blank adapted to be folded into a mailer, the blank comprising a sheet having first and second sides and adhesive bands on at least one of the faces for securing the blank in its folded configuration, at least two of the adhesive bands on the blank being positioned so that when a plurality of blanks are stacked in face to face relation, one of the adhesive bands on the blank aligns with the other of the adhesive bands on an adjacent blank, the at least two adhesive bands formed by a plurality of adhesive patches, the adhesive patches being generally triangularly shaped and spaced with respect to each other such that the individual patches forming the at least two strips do not align, the patches forming one of the at least two adhesive bands that align when a plurality of blanks are stacked face oppositely from the patches forming the other of the at least two adhesive bands.

8. The mailer blank according to claim 7 wherein the generally triangularly shaped patches forming the at least two adhesive bands that align when a plurality of blanks are stacked are spaced from each other less than the dimension of the base of the generally triangularly shaped patches.

* * * * *